United States Patent [19]

Dudley

[11] 4,089,765

[45] May 16, 1978

[54] ELECTROIMPREGNATION OF PAPER AND NON-WOVEN FABRICS

[75] Inventor: Michael A. Dudley, Beaconsfield, Canada

[73] Assignee: Canada Wire and Cable Limited, Toronto, Canada

[21] Appl. No.: 532,696

[22] Filed: Dec. 13, 1974

[30] Foreign Application Priority Data

Dec. 14, 1973 Canada ..... 188217

[51] Int. Cl.[2] ..... C25D 9/00

[52] U.S. Cl. ..... 204/180 R; 162/184; 162/192

[58] Field of Search ..... 162/184, 192; 427/12, 427/13, 439; 204/20, 21, 22, 28, 181, 180 R

[56] References Cited

U.S. PATENT DOCUMENTS

| | | | |
|---|---|---|---|
| 1,672,539 | 6/1928 | Novak | 427/13 |
| 2,015,865 | 10/1935 | Muller | 427/13 |
| 2,898,279 | 8/1959 | Metcalfe et al. | 204/181 |
| 3,434,872 | 3/1969 | Ashpole et al. | 427/12 |
| 3,449,235 | 6/1969 | Burnel | 204/181 |
| 3,484,275 | 12/1969 | Lewicki | 162/192 |
| 3,736,276 | 5/1973 | Crowne et al. | 260/21 |

FOREIGN PATENT DOCUMENTS

| | | | |
|---|---|---|---|
| 25,848 | 3/1970 | Australia | 427/12 |

*Primary Examiner*—Richard V. Fisher
*Assistant Examiner*—William F. Smith
*Attorney, Agent, or Firm*—Fleit & Jacobson

[57] ABSTRACT

A method for electroimpregnation of paper and non-woven fabrics is disclosed. The method comprises the steps of forming an aqueous solution containing about 1-30% of an ionic material having a specific conductance lower than 0.003 mhos $cm^{-1}$, in a bath provided with cathode and anode electrodes submerged in the solution, introducing a sheet of paper or non-woven fabric having a predetermined degree of porosity into the bath in contact with the cathode or anode electrode, dependent on the polarity of the ionic material, and applying a predetermined DC voltage to the electrodes so as to cause the ions of such material to impregnate the paper or non-woven fabric when such ions move toward one or the other of the electrodes and deposit within the paper or non-woven fabric as partially or totally associated molecules. The ionic material may advantageously be a polymeric material to improve the clarity, dielectric strength and moisture absorption resistance characteristics of the paper or non-woven fabric. The ionic material may also be a size or a dye for the paper industry.

10 Claims, No Drawings

ELECTROIMPREGNATION OF PAPER AND NON-WOVEN FABRICS

This invention relates to electroimpregnation of paper and non-woven fabrics with ionic materials.

Several methods of coating or modifying paper or non-woven fabrics are used for various applications. Some of these known methods make use of a doctor-blade spread latex to improve wet rub resistance such as disclosed in French Pat. No. 1,516,761, or of a roller coated solution for the manufacture of release paper as disclosed in U.S. Pat. No. 3,403,045, or of an electrostatic spray to produce paper dish cloths as disclosed in U.S. Pat. No. 3,484,275. Melt extrusion is also used to make release paper as disclosed in German Pat. No. 1,936,001. Still another known method uses graft polymerization for making insulating paper.

Electrodeposition, which has recently evolved into a common technical method for forming protective and decorating coatings on metal surfaces, has also been experienced for depositing onto paper or non-woven fabrics materials dispersed as a suspension into a liquid as disclosed in Canadian Pat. No. 781,420. However, to applicant's knowledge, electrical methods have never been used to impregnate paper or non-woven fabrics having a predetermined degree of porosity with true solutions of materials.

It is therefore the object of the present invention to impregnate paper or non-woven fabrics with ionically charged materials in solution. That is, the materials in solution exist in dissociated states so as to form ionic solutions.

The process, in accordance with the invention, comprises the step of forming an aqueous solution containing about 1 to 30% of an ionic material having a specific conductance lower than 0.003 mhos $cm^{-1}$ in a bath provided with cathode and anode electrodes submerged in the solution, introducing a sheet of paper or non-woven fabric into the bath in contact with the cathode or anode electrode, dependent on the polarity of the ionic material, and applying a predetermined DC voltage to the electrodes so as to cause the ions of such material to impregnate the paper or non-woven fabric as the ions move toward one or the other of the electrodes and deposit within the paper or non-woven fabric as partially or totally associated molecules.

The paper or non-woven fabric may be prewetted to impart thereto a predetermined moisture content so as to prevent excessive buckling of the sheet of paper or non-woven fabric upon immersion into the solution.

It has been found experimentally that the above method may advantageously be used to impregnate paper or non-woven fabric with a polymeric material to improve its dielectric strength and moisture absorption resistance characteristics for use in various electrical applications such as the manufacture of cables and transformers.

After impregnation, the sheet of paper or non-woven fabric may be rinsed to remove surface material prior to drying and/or curing.

The above method has also been successfully used for the impregnation of paper with ionic sizes and dyes for the paper industry. The present in-line sizing operation consists of passing the paper through a puddle of size solution, which is maintained in the nip of two rolls. Sizes include glues, carboxy methyl cellulose and ionic starches. Starches which are used to improve the writing and printing qualities of paper are presently applied at 5 to 10% total solids, with a viscosity of 15–50 centipoise at 140° F, to ensure total impregnation. Papermakers would like to use high concentrations or to go to higher viscosity starches such as 100 centipoise. Experiments have proven that a higher percentage of starch may be impregnated in paper using the electroimpregnation method in accordance with the invention. In practice, the two nip rolls on each side of the paper could be used as the anode and cathode electrodes.

At the present time, only 50% of the dyes used in papermaking can be applied at the size press because of uneven impregnation due to the short residence time of the paper in the nip rolls. Here again, it has been found that electroimpregnation in accordance with the present invention can improve the quality and of the speed of the dyeing operation. Although it has been found that, due to the pH variation of the solution at the surface of the paper during the electroimpregnation, there may be slight changes in the color of the dye, this is not critical and may be controlled.

The invention will now be disclosed with reference to various applications thereof which are disclosed by way of example only with no intention to limit the scope thereof.

A number of tests were made to electroimpregnate paper with a polymeric material. The laboratory apparatus used for electroimpregnation was a cubic glass cell 3.50 inch square filled with an electroimpregnating solution of polymeric material. Two, free moving, 3 inch square stainless steel electrodes were positioned in the glass cell and mounted in polymethyl methacrylate carriers with only one face exposed to the electroimpregnating solution. Various paper samples were prewetted with distilled water to prevent excessive buckling upon immersion into the solution, smoothed onto the anode to remove air bubbles, and taped to the anode around the edges to prevent the deposition of the polymeric material on the anode other than by passage of the solution through the paper samples. After impregnation, the samples were rinsed in distilled water and cured. The cure time was initially set at 4 minutes at 180° C, but was later standardized to 15 minutes at 150° C to eliminate the possibility of charring the paper. It is to be understood that the cure time and temperature may vary depending on the polymeric solution.

The polymeric solution may contain from 1 to 30% resin with the preferable range being 5 to 15%. The resin may be anionic or cationic in nature. The experimental resin used was an epoxy/ester water soluble resin, although any electroimpregnatable synthetic polycarboxylic acid resin, which include epoxy/ester, alkyd, acrylic and polyester resin, can be used.

The paper samples used were "electrical" grades, that is papers in which the incidence of ionic species, which may cause surface deposition of the resin, is very low. Such samples included 0.003 inch thick manilla papers and nitrogen containing heat-resistant papers known in the trade as "Insuldur" and having a thickness of 0.003 to 0.005 inch. The porosity of the paper used is important. Under the laboratory conditions, a paper having a densometer value of 300–400 seconds could be impregnated only to a thickness of 0.005 inch.

Each paper sample, after impregnation and cure, was tested for dielectric breakdown voltage and moisture absorption characteristics. The dielectric breakdown voltage was tested by the Westinghouse method (Westinghouse Electric Corporation, PD Specification 42355 AP through AT Revision J, 1968) which uses a pair of two-inch diameter plate electrodes, connected to a usual voltage tester. The moisture absorpotion was evaluated by exposing pre-dried two-inch diameter impregnated paper samples to 100% relative humidity for 24 hours, and determining the weight gain immediately after removal. The pre-dried sample weight was obtained after exposing the samples to 150° for 15 minutes, and cooling in a desiccator before weighing.

The electroimpregnation may be carried out using substantially constant voltage or constant current. The voltage, current and duration of power required for impregnation are dependent on several factors, namely the electrode separation, the paper porosity and the paper thickness as it will be seen in the following Tables 1 and 2. Electrode separation is the most important variable when using constant voltage, separations of 1.0 to 2.5 inches having been used successfully. The epoxy/ester resin used was the commercially available epoxy resin Epon 1001 (marketed by Shell Chemical Company Limited), derived from epichlorohydrin and bisphenol-A, and esterified with dehydrated castor oil fatty acids to produce an epoxy/ester with an acid value (m.g. potassium hydroxide per gram of resin) of from about 8 to 10, and subsequently heated with succinic anhydride until the acid value reaches about 50. Such an epoxy/ester water soluble resin is more clearly described in U.S. Pat. No. 3,736,276 granted May 29, 1973.

TABLE 1

ELECTROIMPREGNATION OF PAPER USING CONSTANT VOLTAGE AND AN EPOXY/ESTER WATER SOLUBLE RESIN

| Paper | Electrode Separation in. | Applied Voltage, V | Time sec. | Dielectric Breakdown Voltage V | % Moisture Absorption 24 hours at 100% R.H. |
|---|---|---|---|---|---|
| Insuldur 0.003-in. | 1.0 | 100 | 5.12 | 900 | 5.1 |
| | 1.0 | 125 | 5.04 | 900 | 4.4 |
| | 1.0 | 150 | 5.36 | 1100 | 5.8 |
| | 1.5 | 100 | 5.19 | 900 | 4.1 |
| | 1.5 | 125 | 4.88 | 900 | 4.5 |
| | 1.5 | 150 | 5.20 | 900 | 12.1 |
| | 2.5 | 100 | 5.20 | 900 | 4.5 |
| | 2.5 | 125 | 5.04 | 900 | 9.1 |
| | 2.5 | 150 | 5.27 | 900 | 16.9 |
| | Control | — | — | 750 | 12.0 |
| Insuldur 0.005-in. | 1.0 | 100 | 5.27 | 1250 | 4.5 |
| | 1.0 | 125 | 5.03 | 1300 | 5.7 |
| | 1.0 | 150 | 5.27 | 1350 | 5.1 |
| | 1.5 | 100 | 4.96 | 1250 | 4.5 |
| | 1.5 | 125 | 5.04 | 1450 | 5.5 |
| | 1.5 | 150 | 5.12 | 1800 | 5.2 |
| | 2.5 | 100 | 5.04 | 1250 | 1.9 |
| | 2.5 | 125 | 5.19 | 1450 | 3.7 |
| | 2.5 | 150 | 5.19 | 1550 | 3.5 |
| | Control | — | — | 1100 | 13.0 |

TABLE 2

ELECTROIMPREGNATION OF PAPER USING CONSTANT CURRENT AND AN EPOXY/ESTER WATER SOLUBLE RESIN

| Paper | Electrode Separation, in. | Current, amps | Time, sec. | Dielectric Breakdown Voltage V | % Moisture Absorption 24 hours at 100% R.H. |
|---|---|---|---|---|---|
| Insuldur 0.003-in. | 1.0 | 0.2 | 20.25 | 1250 | 2.8 |
| | 1.0 | 0.3 | 10.10 | 1200 | 8.1 |
| | 1.0 | 0.4 | 10.40 | 1450 | 9.3 |
| | 1.0 | 0.5 | 10.72 | 1250 | 5.2 |
| | 1.0 | 1.0 | 5.27 | 1250 | 6.0 |
| | 1.5 | 0.2 | 10.55 | 900 | 12.8 |
| | 1.5 | 0.3 | 10.25 | 1000 | 7.2 |
| | 1.5 | 0.4 | 10.25 | 1000 | 11.5 |
| | 1.5 | 0.5 | 10.15 | 1250 | 6.1 |
| | 2.5 | 0.3 | 10.10 | 1250 | 6.1 |
| | 2.5 | 0.4 | 10.32 | 1250 | 5.8 |
| | 2.5 | 0.5 | 10.48 | 1200 | 8.8 |
| | Control | — | — | 750 | 20.5 |
| Insuldur 0.005-in. | 1.0 | 0.3 | 10.0 | 1350 | 9.3 |
| | 1.0 | 0.5 | 10.15 | 1400 | 6.3 |
| | 1.0 | 0.6 | 10.37 | 1400 | 5.5 |
| | 1.0 | 0.7 | 10.40 | 1450 | 5.2 |
| | 1.5 | 0.4 | 10.15 | 1300 | 7.5 |
| | 1.5 | 0.5 | 10.07 | 1350 | 4.8 |
| | 1.5 | 0.6 | 10.30 | 1300 | 3.1 |
| | 1.5 | 0.7 | 10.07 | 1350 | 4.5 |
| | 2.5 | 0.3 | 9.92 | 1300 | 8.2 |
| | 2.5 | 0.4 | 9.70 | 1300 | 4.2 |
| | 2.5 | 0.5 | 10.30 | 1300 | 4.8 |
| | 2.5 | 0.6 | 10.55 | 1250 | 4.3 |
| | 2.5 | 0.7 | 10.45 | 1400 | 3.2 |
| | Control | — | — | 1100 | 22.5 |

Under the experimental conditions used in the above Tables, average dielectric breakdown voltage improvements of about 55% and 80% were achieved using constant voltage and constant current control respectively. Reduction in moisture absorption was about 70% and 80% using constant voltage and constant current control respectively.

The above disclosed method produces a polymer impregnated paper suitable for electrical insulation applications and which obviates the vacuum drying step in the cable making. Such a polymer impregnated paper may be used, without oil impregnation, for cable insulation.

The above paper impregnation method has also been successfully used for impregnating a 0.004 inch thick non-woven fabric, having a porosity of 300 cfm/sq.ft., with a 5% anionic electrocoating solution of an acrylic resin known under the trademark Baycryl W-460 sold by Bayer Germany. The results of this test are illustrated in the following Table:

TABLE 3

| Electrode Separation in. | Applied Voltage V | Time Seconds | % Moisture Absorption after 24 hrs. at 100% R.H. | Dielectric Breakdown Voltage V |
|---|---|---|---|---|
| 1.0 | 50 | 10 | 9.9 | 950 |
| 1.0 | 75 | 10 | 16.2 | 1,340 |
| 1.0 | 100 | 10 | 2.4 | 1,150 |
| 1.0 | 125 | 10 | 10.9 | 1,300 |
| | Control | | 18.5 | 1,000 |

The results illustrated in the above table show the improvements experienced in the dielectric strength and moisture absorption resistance characteristics of the non-woven fabric.

Various experiments have also been carried out using electroimpregnating solutions containing ionic sizes and dyes. For example, electroimpregnation of a 0.019 inch thick Bond paper, taken from a paper machine prior to entering the size press, was carried out using a 10% solution of a cationic starch known under the trade name Catobond 60. The results of the above experiment are illustrated in the following Table:

TABLE 4

| Paper Treatment | Dip Time, sec. | Electrode Separation, in. | Applied Voltage V | wt. pickup on 2" dia. circle, mg |
|---|---|---|---|---|
| Dry paper, dipped into starch solution | 1.5 | — | — | 1.5 |
| Dry paper, electro-impregnated with starch | 1.5 | 3.0 | 150 | 8.1 |
| Prewetted paper, dipped into starch solution | 1.5 | — | — | 0.9 |
| Prewetted paper, electro-impregnated with starch | 1.5 | 3.0 | 150 | 9.5 |

It will be seen from the above Table that the weight of starch picked up by the paper electroimpregnated with starch is between 5 and 10 times the corresponding weight of starch picked up by paper which is simply dipped into a starch solution.

Electroimpregnation of 0.019 inch thick Bond paper, taken from a paper machine prior to entering the size press, has been carried out with a 1% aqueous solution having 2.5% butyl cellosolve as a coupling solvent, of a cationic dye known under the trade name Chrysoidine Y having the following formula:

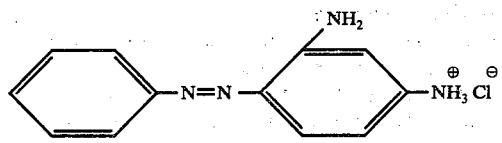

The results of the above experiment are illustrated in the following Table:

TABLE 5

| Paper Treatment | Dip Time, sec. | Electrode Separation, in. | Applied Voltage V | Wt. pickup on 2" dia. circle, mg |
|---|---|---|---|---|
| Prewetted paper, dipped into dye solution | 1.0 | — | — | 1.5 |
| | 30.0 | — | — | 1.9 |
| Prewetted paper, electroimpregnated with dye | 1.0 | 1.5 | 100 | 3.7 |
| | 30.0 | 1.5 | 100 | 16.6 |

In the electroimpregnation Tables 4 and 5, the cathode with either the dry or prewetted paper attached was dipped into the respective solutions with the applied voltage on in order to reproduce the conditions of the straight dip comparisons.

In carrying out electroimpregnation of dyes, sizes and polymeric materials, it became apparent that paper porosity was not a factor upon which a range could be set. It is believed to be obvious to a man skilled in the art to choose a paper or a non-woven fabric of a porosity such as to permit impregnation of the paper or non-woven fabric. However, it is important that to obtain suitable electroimpregnation the specific conductance of the solution, whether dye, size, or polymeric material should be less than 0.003 mhos $cm^{-1}$. It was found that impregnation rate is very low or negligible above that value. The preferred range is from 0.0005 to 0.0015 mhos $cm^{-1}$.

The degree of impregnation is dependent on the molecular weight of the ionic material (ionic starch, resin or dye) and the charge/weight ratio of the ionic material plus the degree of porosity of the paper or non-woven fabric to be impregnated. The lower the molecular weight, the easier the impregnation. Similarly, the higher the charge/weight ratio, the greater is the impregnation. Finally, the higher the porosity the greater is the impregnation.

It is to be understood that the above disclosed impregnation method could be carried out on a continuous basis by impregnating paper at the "wet end" of a paper production line, resulting in both capital equipment and processing cost savings.

Although the invention has been disclosed with reference to electroimpregnation of paper and non-woven fabrics with ionic polymeric materials, ionic sizes and ionic dyes, it is to be understood that it could also be used for the impregnation of paper and non-woven fabrics with other materials such as fire retardants, and also for polymeric transparentizing of paper.

What is claimed is:

1. A method for electroimpregnation of paper and non-woven fabrics comprising the steps of:

(a) forming a bath of an aqueous solution containing about 1–30% of a material which, in said aqueous solution, exists in an at least partially dissociated state, said material having a specific conductance lower than 0.003 mhos $cm^{-1}$;

(b) providing said bath with cathode and anode electrodes submerged in the solution;

(c) introducing a sheet of paper or non-woven fabric having a predetermined degree of porosity into said bath in contact with the cathode or anode electrode, dependant on the polarity of said material; and (d) applying a predetermined DC voltage to the electrodes so as to cause the ions of said material to impregnate the paper or non-woven fabric when said ions move toward one or the other electrode and deposit within the paper or non-woven fabric as at least partially associated molecules.

2. A method as defined in claim 1, wherein said sheet of paper or non-woven fabric has a predetermined moisture content so as to prevent excessive buckling of the sheet of paper or non-woven fabric upon immersion into the solution.

3. A method as defined in claim 1, wherein said ionic material is a polymer used to improve the clarity, dielectric strength and the moisture absorption resistance characteristics of the paper or non-woven fabric.

4. A method as defined in claim 3, wherein, after impregnation, the sheet of paper or non-woven fabric is rinsed to remove surface material prior to drying and/or curing.

5. A method as defined in claim 4, wherein the sheet of paper or non-woven fabric is dried and cured at about 150° C during approximately 15 minutes.

6. A method as defined in claim 3, wherein said polymeric material is an electroimpregnatable synthetic poly carboxylic acid resin.

7. A method as defined in claim 1, wherein said ionic material is a size.

8. A method as defined in claim 7, wherein said size is a starch used to improve the writing and printing qualities of the paper or non-woven fabric.

9. A method as defined in claim 1, wherein said ionic material is a dye used to colour the paper or non-woven fabric.

10. A method as defined in claim 6, wherein said polymeric material is an epoxy/ester, alkyd, acrylic or polyester resin.

* * * * *